US006170448B1

(12) United States Patent
Asakura

(10) Patent No.: US 6,170,448 B1
(45) Date of Patent: Jan. 9, 2001

(54) VARIABLE VALVE TIMING APPARATUS

(75) Inventor: Ken Asakura, Toyota (JP)

(73) Assignee: Toyota Jidosha Kabushiki Kaisha, Toyota (JP)

( * ) Notice: Under 35 U.S.C. 154(b), the term of this patent shall be extended for 0 days.

(21) Appl. No.: 09/238,034

(22) Filed: Jan. 27, 1999

(30) Foreign Application Priority Data

Feb. 3, 1998 (JP) ..... 10-022023

(51) Int. Cl.[7] ..... F01L 1/344; F01L 13/00
(52) U.S. Cl. ..... 123/90.18; 123/90.17
(58) Field of Search ..... 123/90.15, 90.17, 123/90.18, 90.31

(56) References Cited

U.S. PATENT DOCUMENTS

| | | | | |
|---|---|---|---|---|
| 4,517,936 | | 5/1985 | di Argona | 123/90.5 |
| 4,693,214 | | 9/1987 | Titolo | 123/90.18 |
| 5,329,895 | * | 7/1994 | Nishida et al. | 123/90.17 |
| 5,540,197 | * | 7/1996 | Golovatai-Schmidt et al. | 123/90.17 |
| 5,881,690 | * | 3/1999 | Park | 123/90.18 |
| 5,924,397 | * | 7/1999 | Moriya et al. | 123/90.18 |

FOREIGN PATENT DOCUMENTS

| | | |
|---|---|---|
| 0 801 212 A1 | 10/1997 | (EP) . |
| 7-301106 | 11/1995 | (JP) . |
| 9-32519 | 2/1997 | (JP) . |
| 9-60508 | 3/1997 | (JP) . |

OTHER PUBLICATIONS

A. Titolo, *The Variable Valve Timing System–Application on a v8 Engine*, vol. 910009, pp. 8–15.

* cited by examiner

*Primary Examiner*—Wellun Lo
(74) *Attorney, Agent, or Firm*—Oliff & Berridge, PLC

(57) ABSTRACT

A variable valve timing apparatus for engines. Included are a phase adjustor for adjusting the rotational phase of a camshaft relative to a crankshaft and a lift adjustor for axially moving the camshaft. The phase adjustor has a timing pulley rotated synchronously with the crankshaft and a housing fixed to the timing pulley. A vane rotor rotated synchronously with the camshaft is arranged in the housing to define a first pressure chamber and a second pressure chamber in the housing. Hydraulic fluid is delivered to the first and second pressure chambers through oil conduits to rotate the vane rotor with respect to the housing and change the rotational phase of the camshaft relative to the crankshaft. The oil conduits extend through the timing pulley. This prevents the axial movement of the camshaft from affecting the hydraulic pressure of the pressure chambers. Accordingly, the valve timing is varied accurately.

11 Claims, 13 Drawing Sheets

24
24a
53
60
59
65
52
80
58
65a
84
51b
51a
14a
61
56a
27
61b
51
56
22
61c
54b
54a
88
86
56b
60a
55
57
54
91
90
54b
87
89
87
51c
56b
22b
56
51a
61
56a
85
58
81
51b
14a
63
63b
ECU
130
53
26
93
92
94
116
106
107
104
102
114
118
108
107
112
107
110
107
96
95
P
13a

VARIABLE VALVE TIMING APPARATUS

BACKGROUND OF THE INVENTION

The present invention relates to variable valve timing apparatuses that are employed in engines. More particularly, the present invention relates to a variable timing apparatus that includes a phase adjustor and a lift adjustor for controlling valve timing with a three-dimensional cam.

Engine variable valve timing apparatuses control the valve timing of intake valves and exhaust valves in accordance with the operating state of the engine. A variable valve timing apparatus generally includes a timing pulley and a sprocket, which synchronously rotates a camshaft with a crankshaft.

Japanese Unexamined Patent Publication No. 9-60508 describes a typical variable timing apparatus. As shown in FIGS. 10, 11, and 12, the variable valve timing apparatus includes a phase adjustor arranged on one end of a camshaft 202. FIG. 10 is a cross-sectional view taken along line 10—10 in FIG. 11, while FIG. 11 is a cross-sectional view taken along line 11—11 in FIG. 10. FIG. 12 is a cross-sectional view taken along line 12—12 in FIG. 11.

A sprocket 204, which is driven by a crankshaft (not shown), is coupled with a housing 206 and supported to rotate integrally with the housing 206. A vane rotor 208 is arranged in the center of the housing 206 and secured to the end of the camshaft 202 to rotate integrally with the camshaft 202.

Vanes 210 project outward from the hub of the vane rotor 208 to contact the inner wall of the housing 206. Partititions 212 project inward from the housing 206 to contact the hub surface of the vane rotor 208. Cavities 214 are defined between the partitions 212. A first pressure chamber 216 and a second pressure chamber 218 are defined in each cavity 214 between each vane 210 and the partitions 212.

Hydraulic pressure is communicated to the first and second pressure chambers 216, 218 to rotate the vane rotor 208 relative to the housing 206. As a result, the rotational phase of the vane rotor 208 relative to the housing 206 is adjusted. This, in turn, adjusts the rotational phase of the camshaft 202 relative to the crankshaft.

The camshaft 202 has a journal 224, which is supported by a bearing 222 formed in a cylinder head of the engine. A first oil channel, which is connected with a hydraulic unit 220, extends through the cylinder head and connects to an oil groove 226 extending along the peripheral surface of the journal 224. The oil groove 226 is connected to oil conduits 227, 228, which extend through the camshaft 202. The oil conduit 228 is further connected to oil conduits 230, 232, which extend through the vane rotor 208 and lead into the first pressure chambers 216. Accordingly, hydraulic pressure is communicated between the hydraulic unit 220 and the first pressure chambers 216 through the first oil channel, the oil groove 226 and the oil conduits 227, 228, 230, 232.

A second oil channel, which is connected with the hydraulic unit 220, extends through the cylinder head and connects to an oil groove 236 extending along peripheral surface of the journal 224. The oil groove 236 is connected to an oil conduit 238, which extends through the camshaft 202. The oil conduit 238 is further connected to oil conduits 240, 242, 244, which extend through the vane rotor 208 and lead into the second pressure chambers 218. Accordingly, hydraulic pressure is communicated between the hydraulic unit 220 and the second pressure chambers 218 through the second oil channel, the oil groove 236, and the oil conduits 238, 240, 242, 244.

In addition to the phase adjustor, a lift adjustor employed in a variable valve timing apparatus to change the lift amount of intake or exhaust valves with a three-dimensional cam and to control the valve timing is also known in the prior art. Japanese Unexamined Patent Publication No. 9-32519 describes such a lift adjustor. As shown in FIG. 13, three-dimensional cams 302 are arranged on a camshaft 304. A timing pulley 306 is arranged on one end of the camshaft 304. The timing pulley 306 is supported such that it slides axially along and rotates integrally with the camshaft 304. A cylinder 308 is arranged on one side of the timing pulley 306. A piston 310 secured to the end of the camshaft 304 is fitted into the cylinder 308. A pressure chamber 312 is defined between one side of the piston 310 and the inner wall of the cylinder 308. A spring 314 is arranged between the other side of the piston 310 and the timing pulley 306 in a compressed state. When the pressure in the pressure chamber 312 is high, the piston 310 urges the camshaft 304 against the force of the spring 314 toward the right (as viewed in FIG. 13). When the pressure in the pressure chamber 312 is low, the spring 314 pushes the piston 310 and forces the camshaft 304 toward the left.

Hydraulic pressure is communicated between the pressure chamber 312 and an oil control valve 318 through oil conduits 322, 324, which extend through a bearing 320, oil conduits 326, 328, which extend through the camshaft 304, and an oil conduit 332, which extends through a bolt 330. The bolt 330 fastens the piston 310 to the camshaft 304. A microcomputer 316 controls the oil control valve 318 to adjust the hydraulic pressure communicated to the pressure chamber 312 and change the axial position of the camshaft if 304.

Accordingly, the position of contact between each cam 302 and the associated valve lift mechanism is adjusted to alter the opening duration of a corresponding intake valve or exhaust valve in accordance with the profile of the cam 302. This varies the valve timing.

When varying the valve timing with the phase adjustor illustrated in FIGS. 10 to 12, the opening and closing timing of the valves are both varied in the same manner. That is, if the opening timing is advanced, the closing timing is advanced accordingly, and if the opening timing is retarded, the closing timing is retarded accordingly. On the other hand, when varying the valve timing with the lift adjustor illustrated in FIG. 13, the opening and closing timing of the valves are inversely varied. That is, if the opening timing is retarded, the closing timing is advanced, and if the opening timing is advanced, the closing timing is retarded. Therefore, the opening and closing timing of the valves cannot be independently varied. This limits the control of the valve timing.

To solve this problem, the phase adjustor of FIGS. 10 to 12 and the lift adjustor of FIG. 13 can be arranged together on a camshaft to adjust both the rotational phase of a camshaft relative to a crankshaft and the lift amount of the valves. This would reduce the limitations on the opening and closing timing control.

For example, the phase adjustor of FIGS. 10 to 12 incorporating a timing pulley and a sprocket may be arranged on one end of a camshaft, and the lift adjustor of FIG. 13 may be arranged on the other end of the camshaft. In this case, the cylinder 308 of the apparatus illustrated in FIG. 13 is supported at a fixed position on a cylinder head or the like.

When employing the phase adjustor of FIGS. 10 to 12 together with the lift adjustor of FIG. 13, the phase adjustor must be unaffected by the camshaft axial movement that is caused by the lift adjustor of FIG. 13. A spline mechanism 406 such as that shown in FIG. 14 is thus required between a camshaft 402 and a vane rotor 404. The spline mechanism 406 includes splines 408, which extend along the inner surface of the vane rotor 404 and splines 414 extending along an inner gear 412, which is coupled to the camshaft 402. The vane rotor splines 408 and the inner gear splines 414 mesh with one another and are supported such that the gear splines 414 slide axially with respect to the vane rotor splines 408.

In this structure, the communication of hydraulic pressure may be performed in the conventional manner. For example, hydraulic pressure may be communicated from a bearing 416 to a first or second pressure chamber through an oil conduit 420, which extends through a sprocket 418 (the oil conduit 420 may extend through a timing pulley or gear instead), an oil conduit 422, which extends through the camshaft 402, an oil conduit 424, which extends through the inner gear 412, an interior space 426, which is defined in the vane rotor 404, and oil conduits 428, which connect the interior space 426 to the first or second pressure chamber.

However, the existence of the spline mechanism 406 causes difficulties when directly supplying hydraulic pressure from the oil conduit 424 of the inner gear 412, which is connected with the camshaft 402, to the oil conduits 428 of the vane rotor 404. More specifically, hydraulic oil must pass through the interior space 426 of the vane rotor 404 when sent to the oil conduits 428 of the vane rotor 404 from the oil conduit 424, which is connected with the camshaft 402.

Hydraulic oil passes through the interior space 426 regardless of whether the oil is sent to the first pressure chamber or second pressure chamber. Therefore, neither pressure chamber has an exclusive oil passage through which hydraulic oil is supplied. Furthermore, the hydraulic pressure communicated to the first and second pressure chambers cannot be controlled externally with the conventional structure. Accordingly, the vane rotor cannot be moved in a satisfactory manner unless a mechanism for independently supplying both of the pressure chambers with sufficient hydraulic pressure is provided or unless a spring such as that shown in FIG. 13 is used to exert force that substitutes for hydraulic force in one direction, while hydraulic force is applied in the opposite direction.

The interior space 426 would also cause a further problem. When varying the lift amount of the valves, the camshaft 402 moves axially relative to the vane rotor 404 and changes the volume of the interior space 426. Thus, the hydraulic pressure in the interior space 426 changes when the valve lifter varies the lift amount.

This may cause undesirable fluctuations of the pressure communicated through the oil conduits 420, 422, 424, 428, and the interior space 426. This would further interfere with the communication of sufficient hydraulic pressure to one of the pressure chambers.

Therefore, the installation of the phase adjustor of FIGS. 10 to 12 together with the lift adjustor of FIG. 13 on the same camshaft interferes with accurate control of the rotational phase of the camshaft relative to the crankshaft. This may lead to excessive retardation or excessive advancement of the valve timing, thus hindering accurate valve timing control.

SUMMARY OF THE INVENTION

Accordingly, it is an objective of the present invention to a variable valve timing apparatus having a phase adjustor and a lift adjustor that enables accurate control of the valve timing.

To achieve the above objective, the present invention provides a variable valve timing apparatus for an engine. The engine includes a drive shaft, a camshaft rotated by the drive shaft, a cam arranged on the camshaft, and a valve driven by the cam with a certain timing and a certain amount of lift. The variable valve timing apparatus changes the rotational phase of the camshaft relative to the drive shaft to vary the valve timing. The apparatus includes a first rotating body rotated synchronously with the drive shaft. The first rotating body houses a fluid pressure chamber. A second rotating body rotates synchronously with the camshaft. The second rotating body includes a movable pressure receiver to which the fluid pressure of the pressure chamber is applied. Movement of the pressure receiver rotates the second rotating body relative to the first rotating body to change the rotational phase of the camshaft relative to the drive shaft. A fluid passage delivers fluid to the pressure chamber to move the pressure receiver. The fluid passage extends through the first rotating body.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

The present invention will now be described with reference to FIGS. 1 to 9. In the preferred and illustrated embodiment, a variable valve timing apparatus 10 is arranged on an intake camshaft of an engine.

Figure 1:
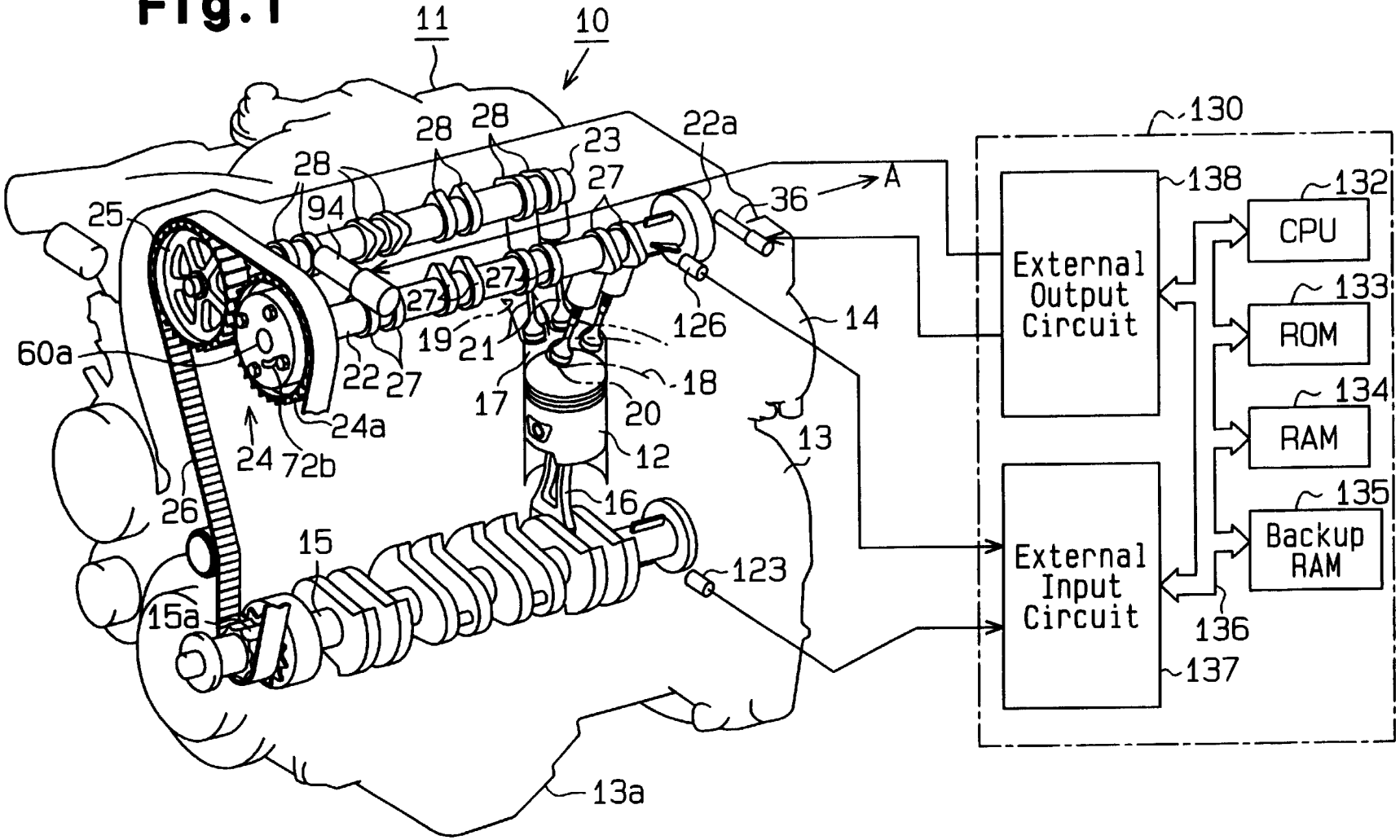
FIG. 1 is a partial perspective view combined with a block diagram showing an engine in which a variable valve timing apparatus according to the present invention is installed.

FIG. 1 shows an in-line four-cylinder gasoline engine 11 mounted in an automobile. The engine 11 includes a cylinder block 13 housing pistons 12 (only one shown), an oil pan 13*a* located below the cylinder block 13, and a cylinder head 14 covering the cylinder block 13.

A drive shaft, or crankshaft 15, is rotatably supported in the lower portion of the engine 11. Each piston 12 is connected to the crankshaft 15 by a connecting rod 16. The connecting rod 16 converts the rotation of the crankshaft to reciprocal movement of the piston 12. A combustion chamber 17 is defined above the piston 12. An intake manifold 18 and an exhaust manifold 19 are connected to the combustion chamber 17. Each combustion chamber 17 and the intake manifold 18 are selectively connected to and disconnected from each other by an intake valve 20. Each combustion chamber 17 and the exhaust manifold 19 are selectively connected to and disconnected from each other by an exhaust valve 21.

An intake camshaft 22 and a parallel exhaust camshaft 23 extend through the cylinder head 14. The intake camshaft 22 is supported such that it is rotatable and axially movable in the cylinder head 14. The exhaust camshaft 23 is supported such that it is rotatable, though axially fixed, in the cylinder head 14.

A phase adjustor 24, including an intake timing pulley 24*a*, is arranged on one end of the camshaft 22, and a camshaft moving mechanism, or lift adjustor 22*a*, is arranged on the opposite end. The lift adjustor 22*a* axially moves the intake camshaft 22. An exhaust timing pulley 25 is secured to one end of the exhaust camshaft 23. The exhaust timing pulley 25 and the intake timing pulley 24*a* of the phase adjustor 24 are connected to a pulley 15*a*, which is secured to a crankshaft 15, by a timing belt 26. The timing belt 26 transmits the rotation of the crankshaft 15, serving as the drive shaft, to the intake camshaft 22 and the exhaust camshaft 23, which serve as driven shafts. Thus, the intake camshaft 22 and the exhaust camshaft 23 are rotated synchronously with the crankshaft 25.

An intake cam 27 is arranged in correspondence with each intake valve 20. Each intake cam 27 contacts the top of the associated intake valve 20. An exhaust cam 28 is arranged in correspondence with each exhaust valve 21. Each exhaust cam 28 contacts the top of the associated exhaust valve 21. Rotation of the intake camshaft 22 opens and closes the intake valves 20 with the associated intake cams 27, while rotation of the exhaust camshaft 23 opens and closes the exhaust valves 21 with the associated exhaust cams 28.

The cross-sectional profile of each exhaust cam 28 remains identical in the axial direction of the exhaust camshaft 23. However, the cross-sectional profile of each intake cam 27 varies continuously in the axial direction of the intake camshaft 22. Accordingly, each intake cam 27 functions as a three-dimensional cam.

Figure 2:
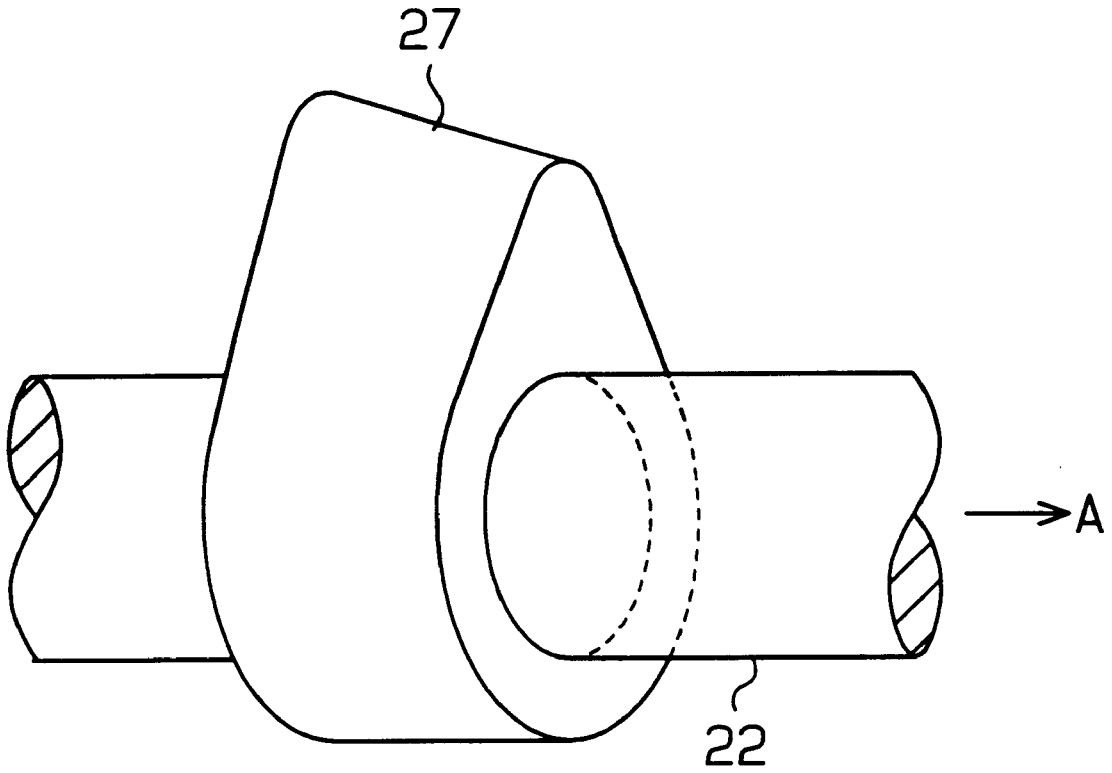
FIG. 2 is a partial perspective showing the intake cam of FIG. 1.

Movement of the intake camshaft 22 in the direction of arrow A, as viewed in FIGS. 1 and 2, causes each intake cam 27 to gradually increase the lift amount and thus the opening duration of the associated intake valve 20. Movement of the intake camshaft 22 in the direction opposite to that indicated by arrow A causes each intake cam 27 to gradually decrease the lift amount and thus decrease the opening duration of the associated intake valve 20. Accordingly, axial movement of the intake camshaft 22 adjusts the lift amount and opening duration of the intake valves 20.

The intake camshaft 22 may be controlled to move in the direction opposite to that of arrow A when the engine 11 is running in a low speed range. This would decrease the opening duration and lift amount of each intake valve 20 and thus increase the force of the air-fuel mixture entering the associated combustion chamber 17 when the engine speed is low. The intake camshaft 22 may also be controlled to move in the direction of arrow A when the engine 11 is running in a high speed range. This would increase the opening duration and lift amount of each intake valve 20 and thus efficiently draw air-fuel mixture into the associated combustion chamber 17 when the engine speed is high.

Figure 3:
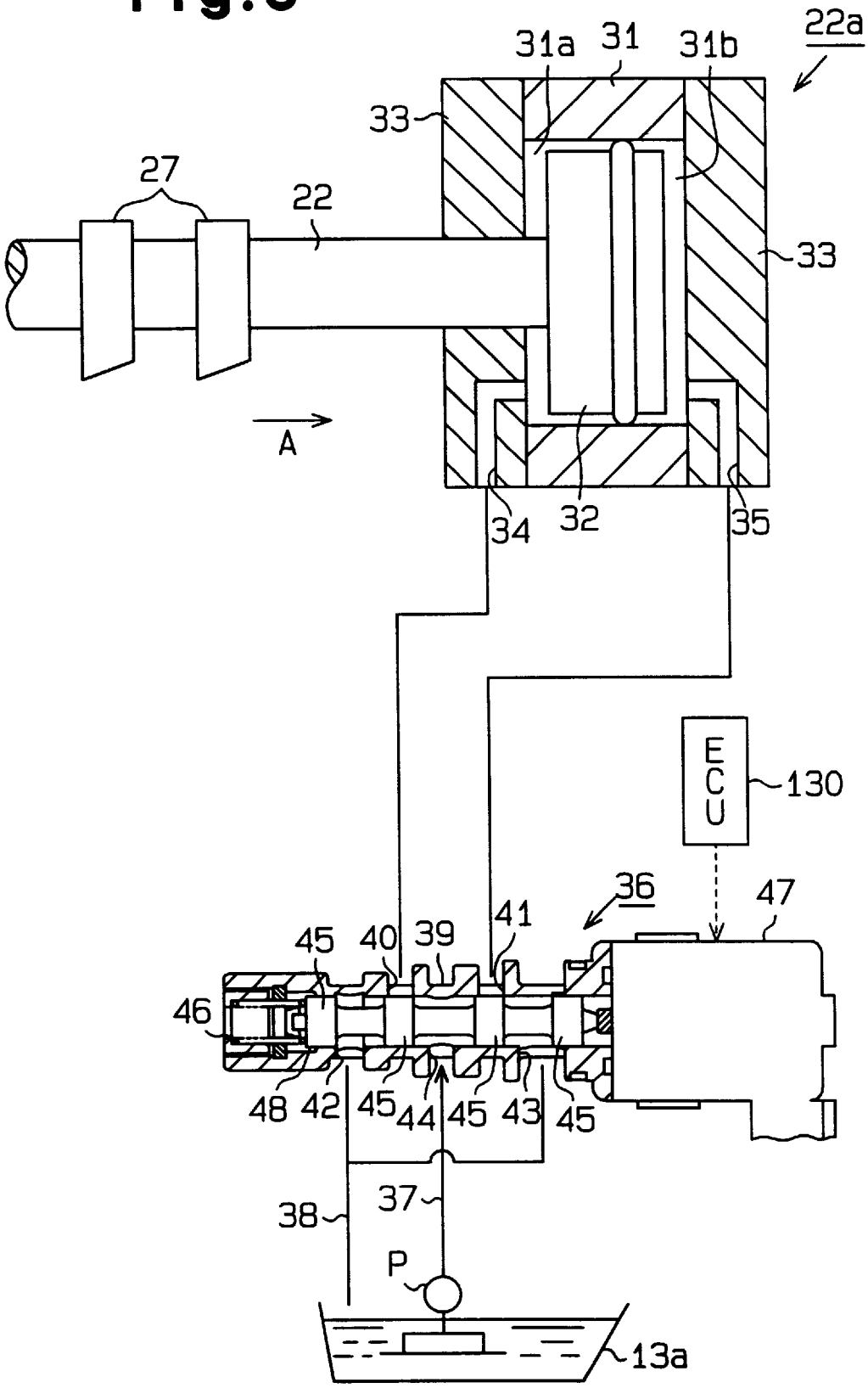
FIG. 3 is a schematic cross-sectional view showing a lift adjustor incorporated in the variable valve timing apparatus of FIG. 1.

The lift adjustor 22*a*, which moves the intake camshaft 22 axially to vary the lift amount of the intake valves 20, will now be described in detail. As shown in FIG. 3, the lift adjustor 22*a* includes a cylinder tube 31, a piston 32 accommodated in the cylinder tube 31, and a pair of end covers 33 closing the ends of the cylinder tube 31. The cylinder tube 31 is fixed to the cylinder head 14.

The piston 32 is coupled to the intake camshaft 22, which extends through one of the end covers 33. A first pressure chamber 31*a* and a second pressure chamber 31*b* are defined in the cylinder tube 31 by the piston 32. A first conduit 34 extending through camshaft side end cover 33 is connected with the first pressure chamber 31*a*. A second conduit 35 extending through the other end cover 33 is connected with the second pressure chamber 31*b*.

Hydraulic oil is selectively supplied to the first and second pressure chambers 31*a*, 31*b* by way of the associated first and second conduits 34, 35 to move the piston 32 in the axial direction of the intake camshaft 22. Accordingly, the piston 32 axially moves the intake camshaft 22.

The first and second conduits 34, 35 are connected to a first oil control valve 36. A supply channel 37 and a discharge channel 38 are connected to the first oil control valve 36. The supply channel 37 is connected to the oil pan 13*a* by way of an oil pump P, which is driven by the rotation of the crankshaft 15. The discharge channel 38 is directly connected to the oil pan 13*a*.

The first oil control valve 36 includes a casing 39. The casing 39 has a first supply/discharge port 40, a second supply/discharge port 41, a first discharge port 42, a second discharge port 43, and a supply port 44. The first supply/discharge port 40 is connected to the first conduit 34, while the second supply/discharge port 41 is connected to the second conduit 35. The supply port 44 is connected to the supply channel 37. The first and second discharge ports 42, 43 are connected to the discharge channel 38. A spool 45 having four valve elements 45 is accommodated in the casing 39. A coil spring 46 and an electromagnetic solenoid 47 urge the spool 48 in opposite directions, respectively.

When the electromagnetic solenoid 47 is de-excited, the spool 48 is moved to one side of the casing 39 (to the right side as viewed in FIG. 3) by the force of the coil spring 46. This connects the first supply/discharge port 40 to the first discharge port 42 and the second supply/discharge port 41 to the supply port 44. In this state, the hydraulic oil contained in the oil pan 13*a* is sent to the second pressure chamber 31*b* through the supply channel 37, the first oil control valve 36, and the second conduit 35. In addition, the hydraulic oil in the first pressure chamber 31*a* is returned to the oil pan 13*a* through the first conduit 34, the first oil control valve 36, and the discharge channel 38. As a result, the piston 32 and the intake camshaft 22 are moved in the direction opposite to that of arrow A.

When the electromagnetic solenoid 47 is excited, the spool 48 is moved to the other side of the casing 39 (to the left side as viewed in FIG. 3), countering the force of the coil spring 46. This connects the second supply/discharge port 41 to the second discharge port 43 and the first supply/discharge port 40 to the supply port 44. In this state, the hydraulic oil contained in the oil pan 13*a* is sent to the first pressure chamber 31*a* through the supply channel 37, the first oil control valve 36, and the first conduit 34. In addition, the hydraulic oil in the second pressure chamber 31*b* is returned to the oil pan 13*a* through the second conduit 35, the first oil control valve 36, and the discharge channel 38. As a result, the piston 32 and the intake camshaft 22 are moved in the direction of arrow A.

By further controlling the current fed to the electromagnetic solenoid 47 to arrange the spool 48 at an intermediate position in the casing 38, the first and second supply/discharge ports 40, 41 are closed. Thus, the flow of hydraulic oil through each supply/discharge port 40, 41 is prohibited. In this state, hydraulic oil is neither supplied to nor discharged from the first and second pressure chambers 31*a*, 31*b*. This sustains the amount of the hydraulic oil residing in each pressure chamber 31*a*, 31*b* and thus locks the piston 32 and the intake camshaft 22 at a fixed position.

Figure 4:
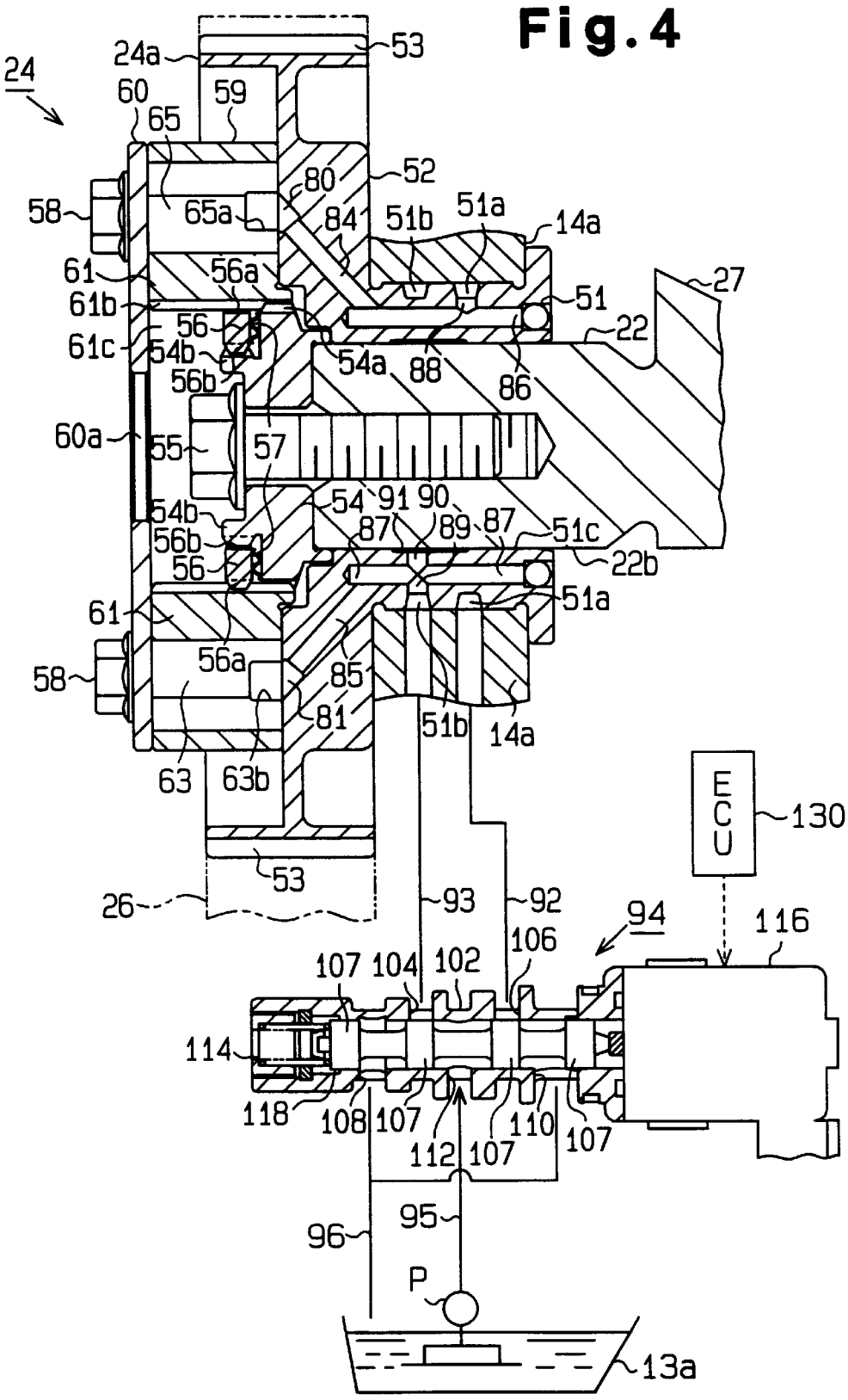
FIG. 4 includes a schematic view showing a phase adjustor incorporated in the variable valve timing apparatus of FIG. 1 and a cross-sectional view taken along line 4—4 of FIG. 6.

The phase adjustor 24, which varies the valve timing of the intake valves 20, will now be described in detail. As shown in FIG. 4, the phase adjustor 24 includes the timing pulley 24*a*. The timing pulley 24*a* has a hub 51, through which the intake camshaft 22 extends, a circular plate 52 extending from the peripheral surface of the hub 51, and outer teeth 53 extending from the periphery of the circular plate 52. The cylinder head 14 has a bearing 14*a* to rotatably support the hub 51 of the timing pulley 24*a*. The intake camshaft 22 is supported such that it slides in the axial direction of the hub 51.

Figure 5:
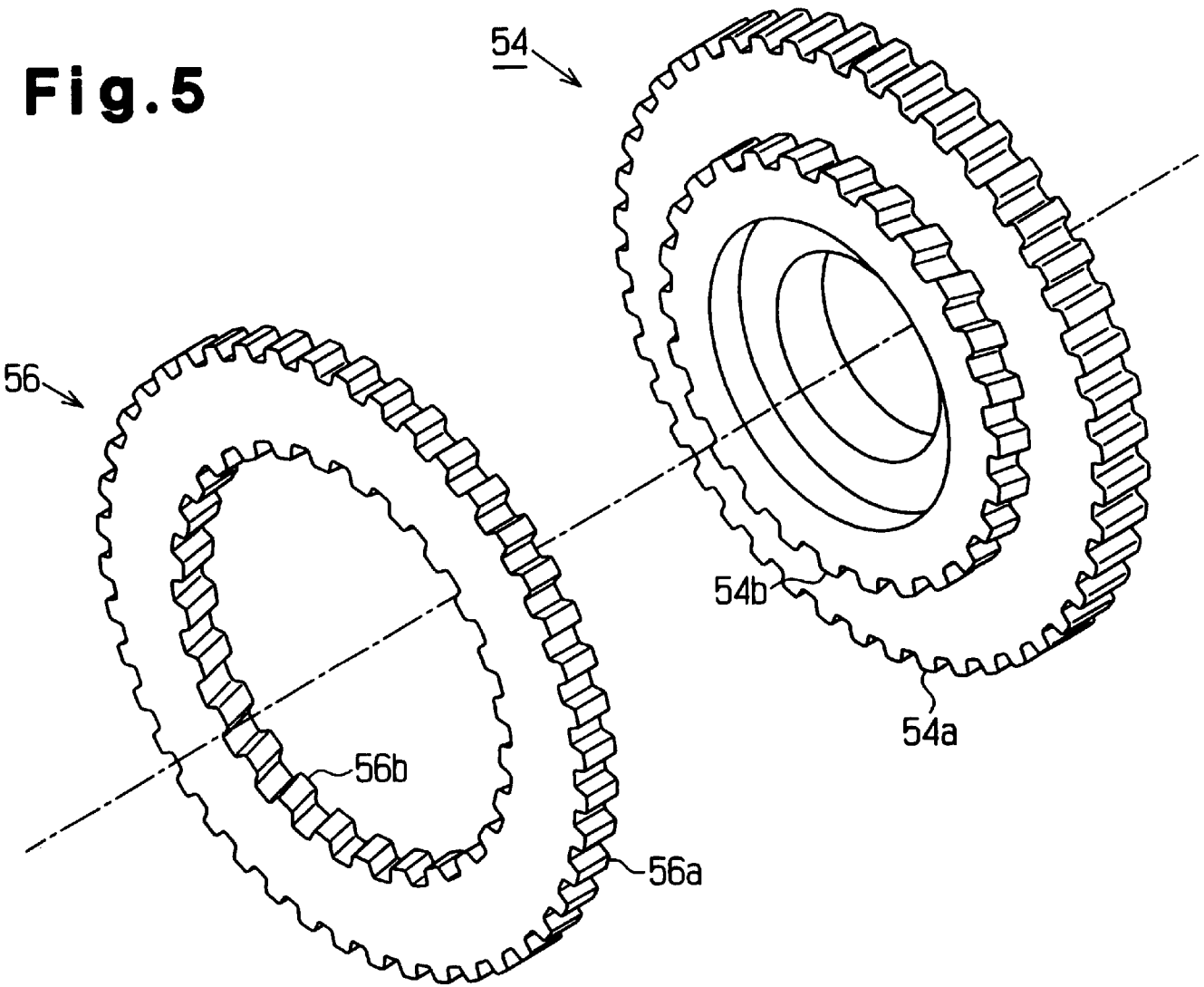
FIG. 5 is an exploded perspective view showing an inner gear and a sub-gear, which are employed in the rotational phase difference adjustor of FIG. 4.

An inner gear 54 is fastened to the intake camshaft 22 by a bolt 55 in a manner covering the end of the intake camshaft 22. As shown in FIG. 5, the inner gear 54 has a large gear portion 54*a* with straight splines, which extend in the axial direction, and a small gear portion 54*b* with helical splines.

The small gear portion 54*b* of the inner gear 54 is engaged with a sub-gear 56. The sub-gear 56 has straight outer splines 56*a*, which extend in the axial direction, and helical inner splines 56*b*. As shown in FIG. 4, the helical inner splines 56*b* of the sub-gear 56 mesh with the helical splines of the small gear portion 54*b*. An annular spring 57 is arranged between the inner gear 54 and the sub-gear 56 to urge the sub-gear 56 away from the inner gear 54 in the axial direction. The outer diameter of the inner gear 54 is equal to that of the sub-gear 56.

A housing 59 and a housing cover 60 are fastened to the circular plate 52 of the timing pulley 24*a* by a plurality of bolts 58 (four are used in the preferred embodiment). An opening 60*a* extends through the central portion of the housing cover 60. This prevents the housing cover 60 from interfering with the axial movement of the intake camshaft 22.

Figure 6:
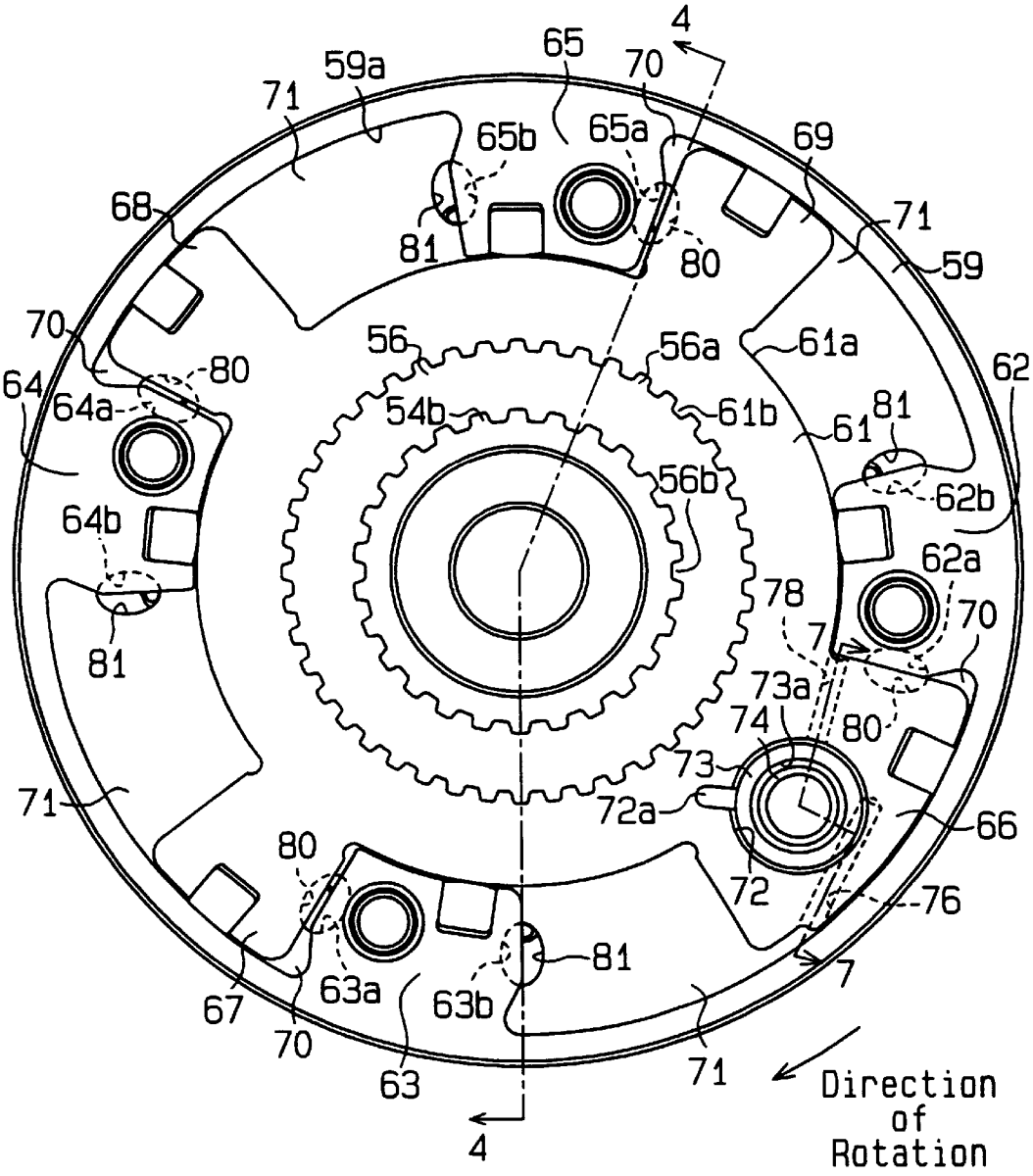
FIG. 6 is an end view with parts removed showing the interior of the phase adjustor of FIG. 4.

FIG. 6 shows the interior of the housing 59 with the bolts 55, 58 and the cover 60 removed from the housing 59. As shown in FIG. 6, the housing 59 has an inner wall 59*a* from which partitions 62, 63, 64, 65 extend radially inward. A cavity is defined between each adjacent pair of partitions 62, 63, 64, 65. A vane rotor 61 is held between the partitions 62, 63, 64, 65. The vane rotor 61 (second rotating body) has a cylindrical surface 61*a* contacted by the partitions 62, 63, 64, 65 such that the vane rotor 61 is rotatable.

A cylindrical space 61*c* is defined at the central portion of the vane rotor (FIG. 4). Splines 61*b* extend along the inner surface of the vane rotor 61 in the axial direction of the intake camshaft 22. The splines 61*b* mesh with the large gear portion 54*a* of the inner gear 54 and the outer splines 56*a* of the sub-gear 56.

The mating of the helical splines 56*b* with the helical splines of the small gear portion 54*b* and the force of the spring 57 produce a force that relatively rotates the inner gear 54 and the sub-gear 56 in opposite directions. This prevents backlash between the splines 61*b* and the gears 54, 56. Thus, the inner gear 54 is rotated such that its rotational phase relative to the vane rotor 61 is highly accurate. Accordingly, the vane rotor 61 is accurately rotated such that its rotational phase relative to the intake camshaft 22 is very precise. For the sake of brevity, not all of the splines 61*b* are illustrated in FIG. 4. However, the splines 61*b* are actually formed along the entire inner surface of the vane rotor 61 in the cylindrical space 61*c*.

Vanes 66, 67, 68, 69 project from the cylindrical surface 61*a* of the vane rotor 61 respectively into the cavities defined between the partitions 62, 63, 64, 65. The vanes 66, 67, 68, 69 contact the inner wall 59*a* of the housing 59. Each vane 66, 67, 68, 69 defines a first pressure chamber 70 and a second pressure chamber 71 in the cavity between the associated pair of adjacent partitions 62, 63, 64, 65.

Figure 7:
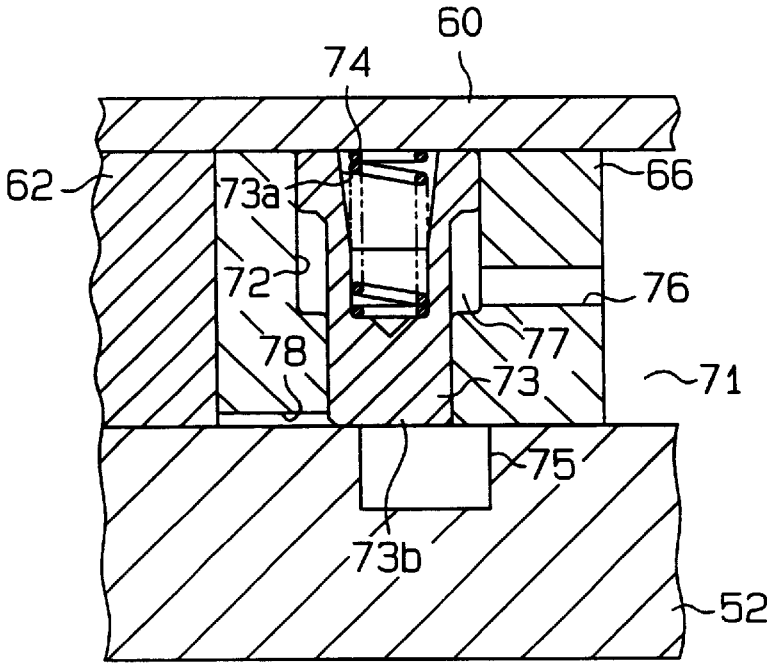
FIG. 7 is a partial cross-sectional view taken along line 7—7 in FIG. 6.
Figure 8:
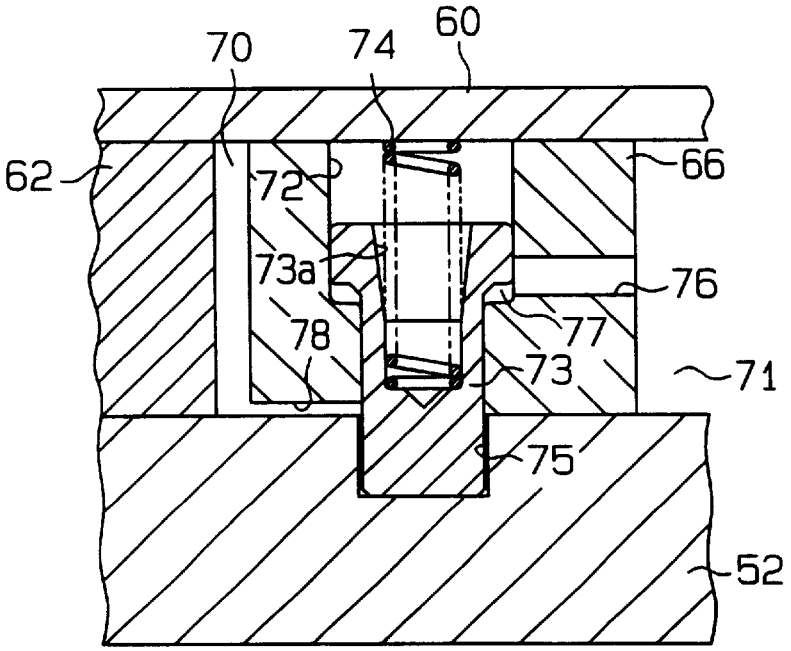
FIG. 8 is a partial cross-sectional view showing the lock pin of FIG. 7 in an actuated state.
Figure 9:
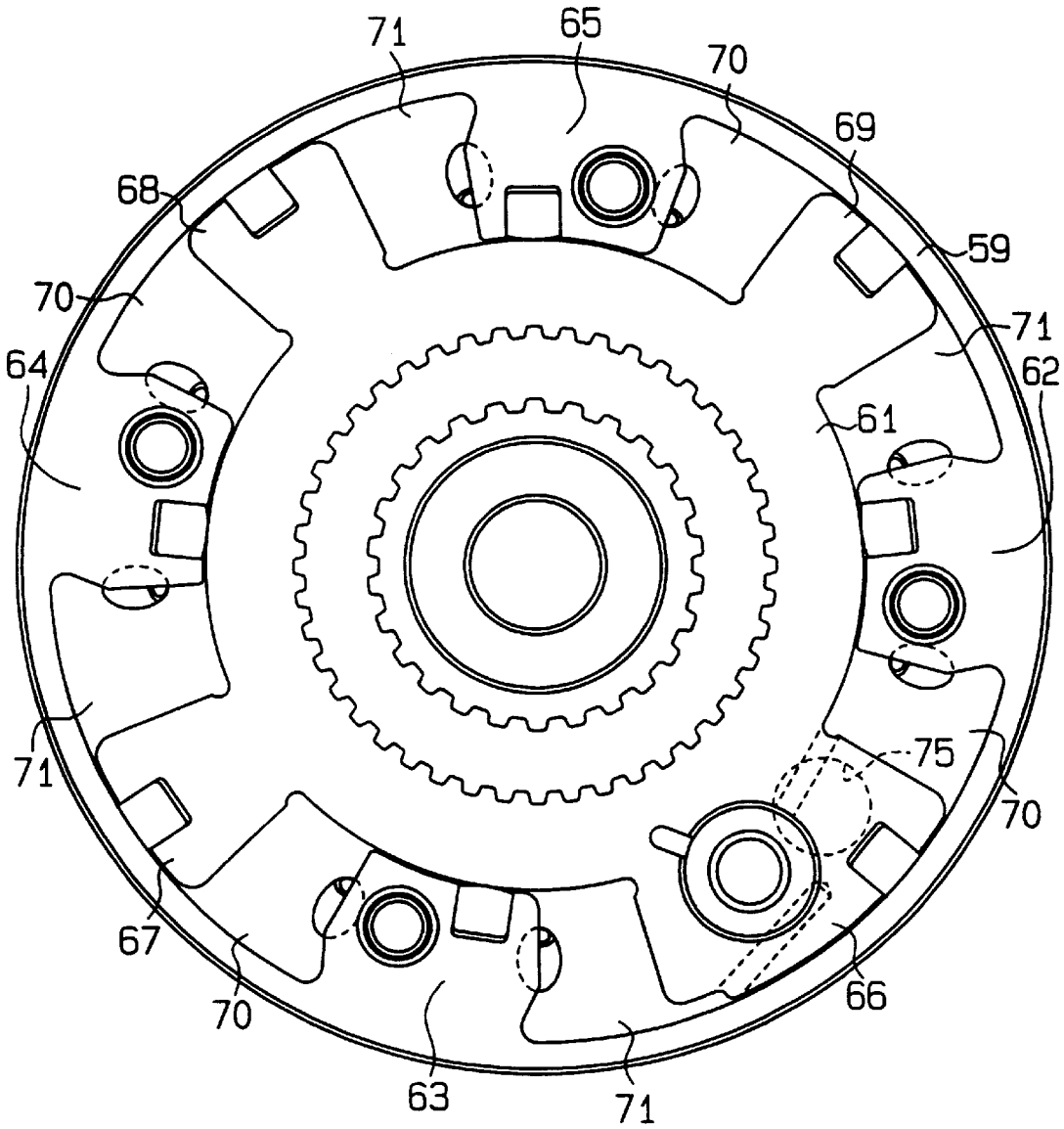
FIG. 9 is an end view like FIG. 6 showing a vane rotor of the phase adjustor of FIG. 6 in a rotated state.
Figure 10:
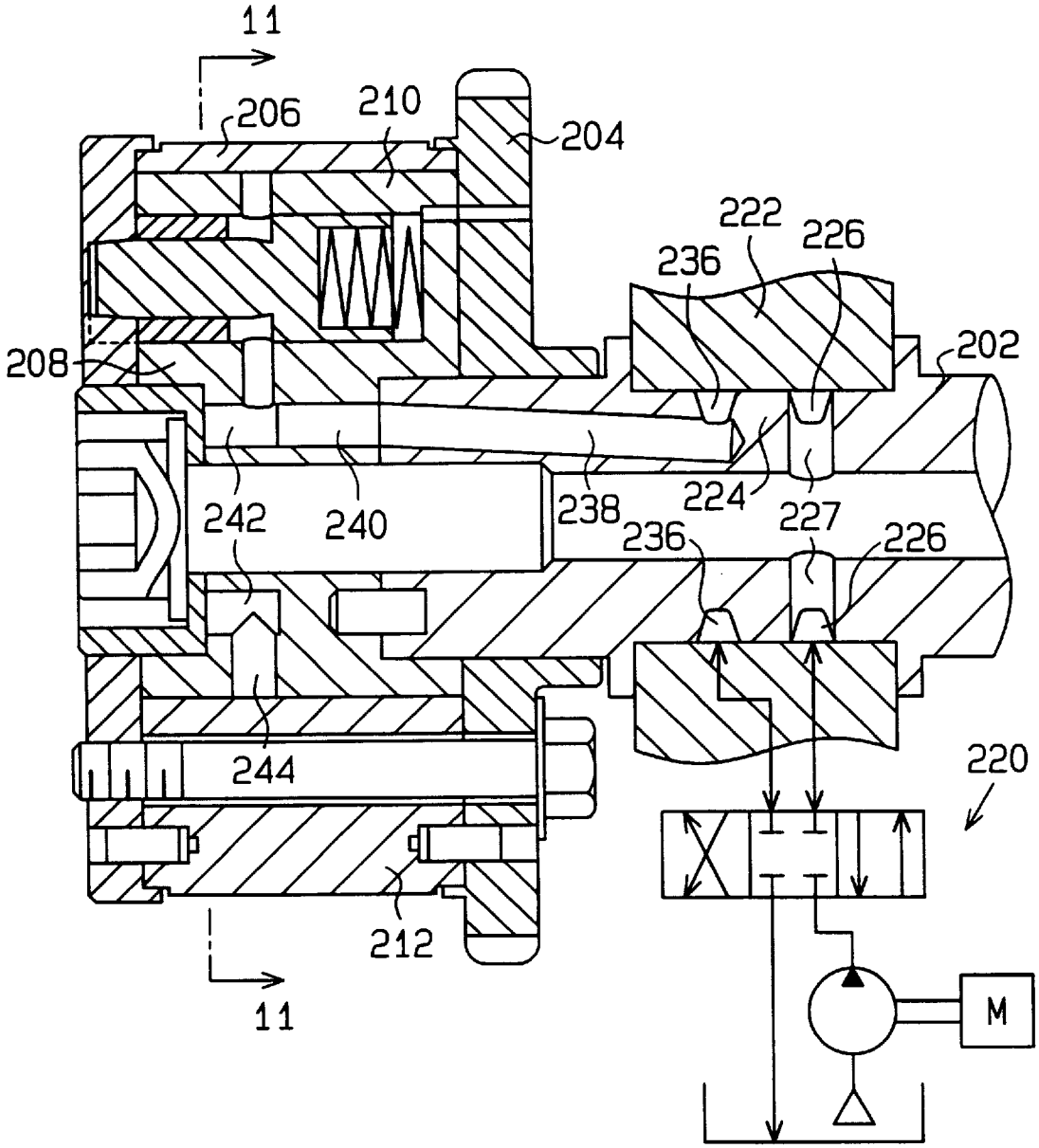
Fig.10(Prior Art)
FIG. 10 is a schematic cross-sectional view taken along line 10—10 in FIG. 11 showing a prior art variable valve timing apparatus that employs a phase adjustor.
Figure 11:
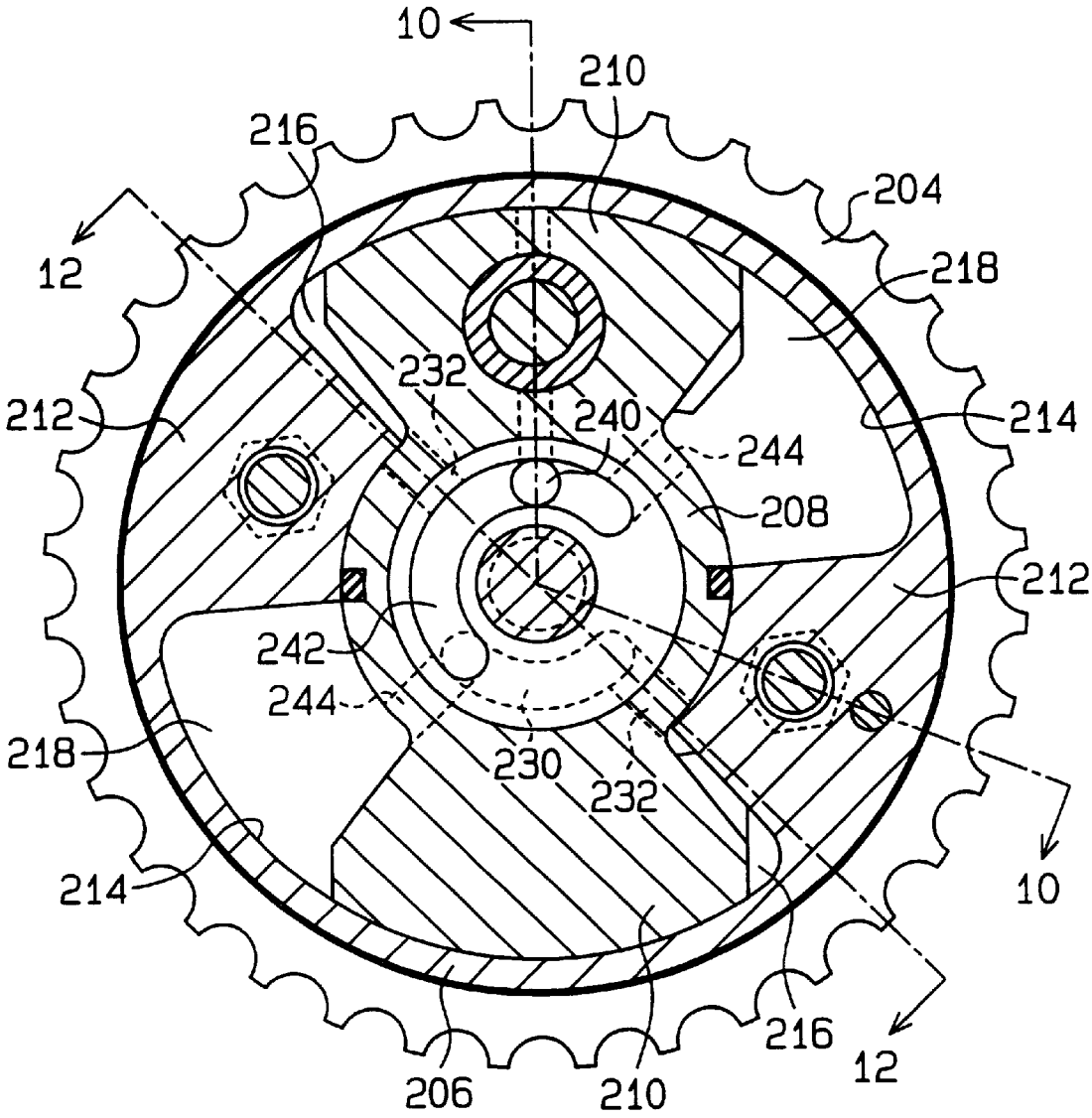
Fig.11 (Prior Art)
FIG. 11 is a cross-sectional view taken along line 11—11 in FIG. 10.
Figure 12:
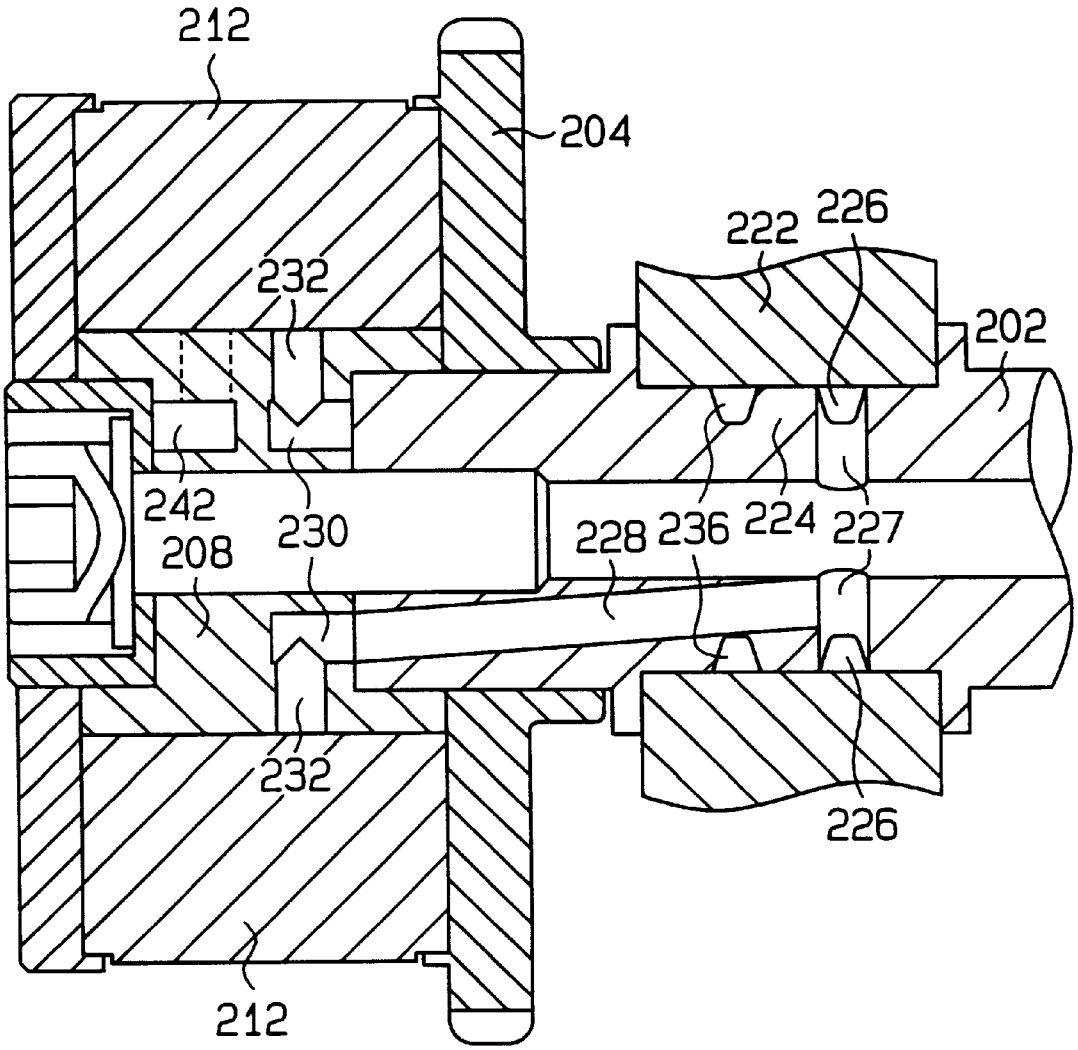
Fig.12(Prior Art)
FIG. 12 is a cross-sectional view taken along line 12—12 in FIG. 11.
Figure 13:
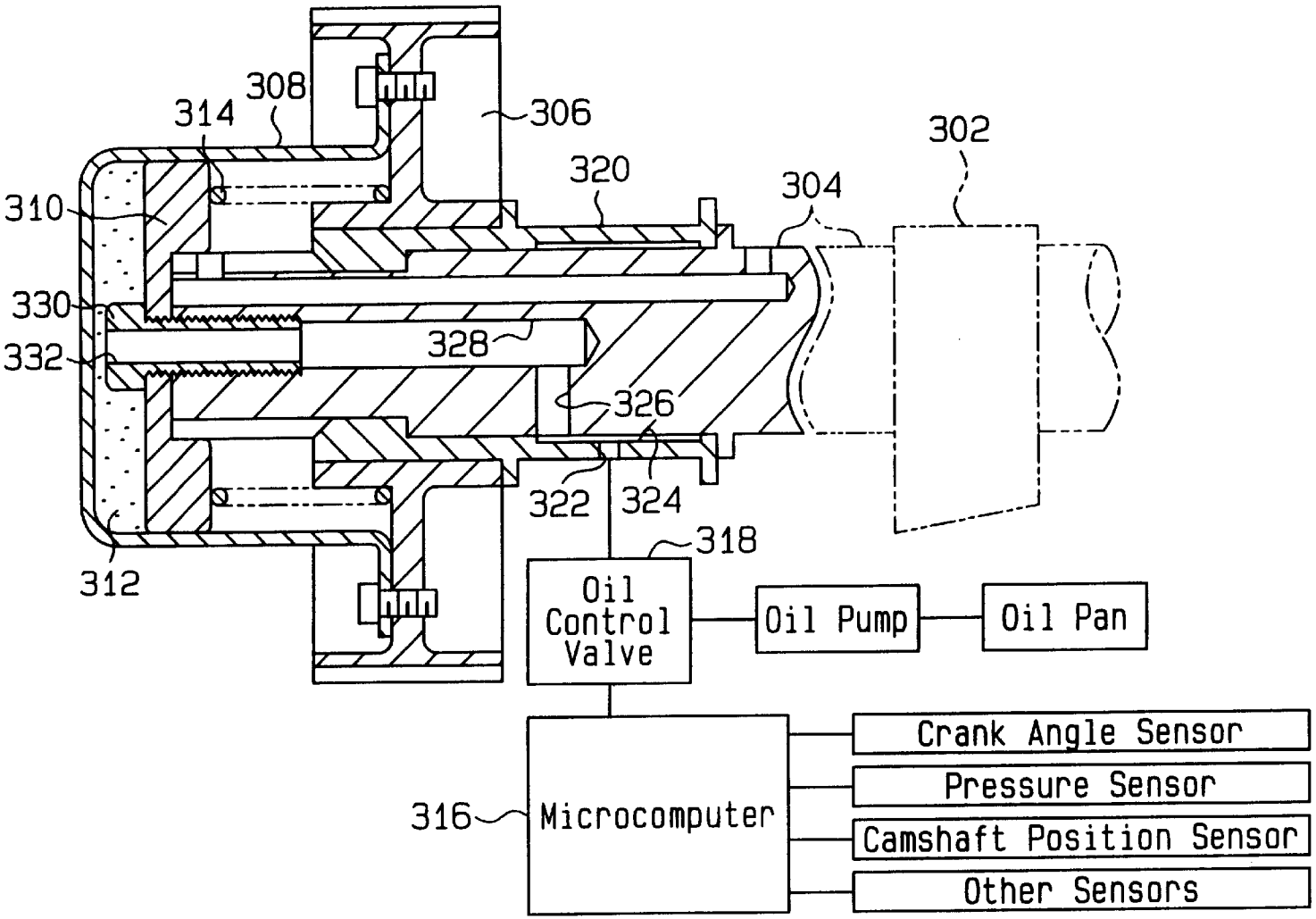
Fig.13(Prior Art)
FIG. 13 is a schematic cross-sectional view showing a prior art variable valve timing apparatus that employs a lift adjustor.
Figure 14:
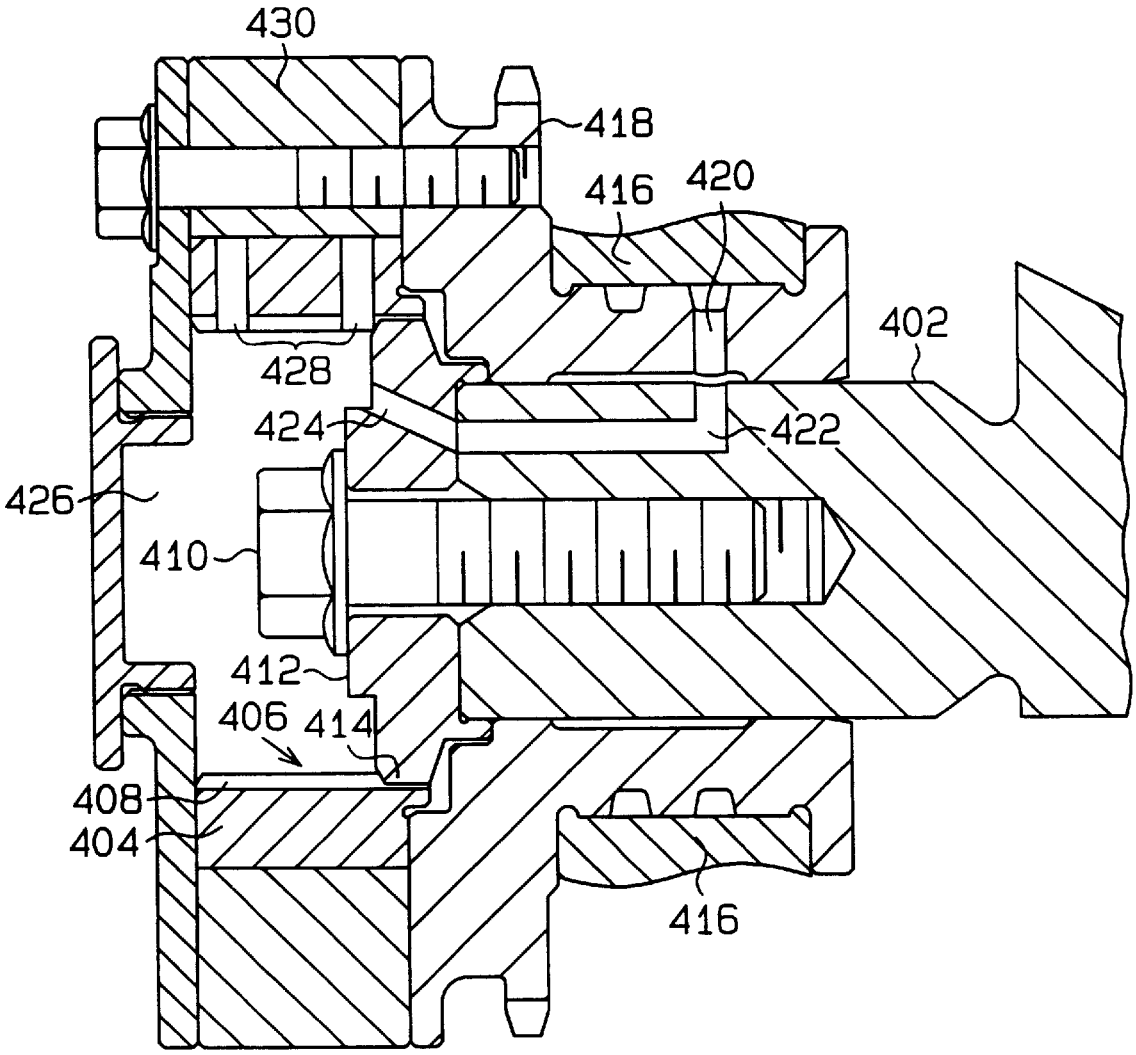
Fig.14(Prior Art)
FIG. 14 is a partial cross-sectional view showing a variable valve timing apparatus that employs the phase adjustor of FIGS. 10 to 12 and the lift adjustor of FIG. 13.

As shown in FIGS. 6 to 8, a bore 72 extends in the axial direction of the intake camshaft 22 in one of the vanes 66. A movable lock pin 73 is accommodated in the bore 72. The lock pin 73 has a hole 73*a* in which a spring 74 is retained to urge the lock pin 73 toward the circular plate 52.

An oil groove 72*a* extends along the front surface of the vane rotor 61 from the bore 72. The oil groove 72*a* connects the bore 72 with an arcuate opening 72*b* (FIG. 1), which extends through the cover 60. The arcuate opening 72*b* and the oil groove 72*a* function to externally discharge air or oil that resides between the cover 60 and the lock pin 73 in the bore 72.

As shown in FIGS. 7 and 8, a socket 75 is provided in the circular plate 52. When the lock pin 73 is aligned with the socket 75 (the state shown in FIG. 8), the spring 74 forces the distal end 73*b* of the lock pin 73 to enter the socket 75. In this state, the circular plate 52 and the vane rotor 61 are locked to each other such that their relative positions are fixed. FIG. 6 and 7 shows the vane rotor 61 arranged at a maximum retardation position. In this state, the lock pin 73 arranged in the vane 66 is misaligned with the socket 75. Thus, the lock pin 73 is located outside the socket 75.

The hydraulic pressure in the first and second pressure chambers 70, 71 is null or insufficient when starting the engine 11 or before an electronic control unit (ECU) 130 (FIG. 4) commences hydraulic pressure control. In this state, cranking of the engine 11 produces counter torque, which is applied to the intake camshaft 22. This rotates the vane rotor 61 relative to the housing 59 in the advancement direction. Thus, from the state shown in FIG. 7, the lock pin 73 is moved until it aligns and enters the socket 75 as shown in FIG. 8. This prohibits relative rotation between the vane rotor 59 and the housing 59. In other words, the vane rotor 61 and the housing 59 rotate integrally with each other.

As shown in FIGS. 7 and 8, an oil conduit 76 extends through the vane 66 from the associated second pressure chamber 71 to an annular space 77 defined in the bore 72. The hydraulic pressure in the annular space 77 is increased through the oil conduit 76 to move the lock pin 73 out of the socket 75 against the urging force of the spring 74 and release the lock pin 73. A further oil conduit 78 extends through the vane 66 from the associated first pressure chamber 70 to provide the socket 75 with hydraulic pressure when the lock pin 73 is released from the socket 75. This maintains the lock pin 73 in the released state. Relative rotation between the housing 59 and the vane rotor 61 is permitted when the lock pin 73 is released. In this state, the rotational phase of the vane rotor 61 relative to the housing 59 is adjusted in accordance with the hydraulic pressure communicated to the first and second pressure chambers 70, 71. For example, the rotational phase of the vane rotor 61 relative to the housing 59 can be advanced to the state shown in FIG. 9 from the state shown in FIG. 6.

The engine 11 rotates the crankshaft 15. The rotation of the crankshaft 15 is transmitted to the timing pulley 24*a* by the timing pulley 26. This rotates the intake camshaft 22 integrally with the timing pulley 24*a*. The intake camshaft 22 rotates with its rotational phase relative to the crankshaft 15 adjusted in accordance with the state of the engine 11. The rotation of the intake camshaft 22 also opens and closes the intake valves 20 (FIG. 1).

When the engine 11 is running, if the hydraulic pressure communicated to the first and second pressure chambers 70, 71 is controlled such that rotation of the vane rotor 61 relative to the housing 59 is advanced, or moved ahead, in the rotating direction of the intake camshaft 22, the valve timing of the intake valves 20 is advanced. In other words, the valve timing of the intake valves 20 is advanced when the rotational phase of the intake camshaft 22 is advanced relative to the crankshaft 15.

On the other hand, if the vane rotor 61 relative to the housing 59 is retarded, or moved in the direction opposite the rotating direction of the intake camshaft 22, the valve timing of the intake valves 20 is retarded. In other words, the valve timing of the intake valves 20 is retarded when the rotational phase of the intake camshaft 22 is retarded relative to the crankshaft 15.

The valve timing of the intake valves 20 is normally retarded when the engine 11 is running in a low speed range and advanced when the engine 11 is running in a high speed range. This stabilizes operation of the engine 11 when the engine 11 is running in the low speed range. This also improves intake efficiency of the air-fuel mixture drawn into each combustion chamber 17 when the engine 11 is running in the high speed range.

As shown in FIGS. 4 and 6, an advancing conduit port 80 is connected with each first pressure chamber 70 next to the associated partition 62–65. A retarding conduit port 81 is connected with each second pressure chamber 71 next to the associated partition 62–65. The partitions 62, 63, 64, 65 have sinks 62*a*, 63*a*, 64*a*, 65*a*, respectively. The sinks 62*a*–65*a* face toward the circular plate 52 and prevent the ports 80 from being closed by the associated partitions 62–65. Thus, the first pressure chambers 70 are always provided with hydraulic pressure that acts to rotate the vane rotor 61 in the advancing direction. In the same manner, the partitions 62, 63, 64, 65 have sinks 62*b*, 63*b*, 64*b*, 65*b*, respectively. The sinks 62*b*–65*b* face toward the circular plate 52 and prevent the ports 81 from being closed by the associated partitions 62–65. Thus, the second pressure chambers 71 are always provided with hydraulic pressure that acts to rotate the vane rotor 61 in the retarding direction.

Outer grooves 51*a*, 51*b* extend along the hub 51 of the timing pulley 24*a*. An advancing conduit 84 extends from each advancing conduit port 80 through the circular plate 52. Each advancing conduit 84 is further connected to advancing conduits 86, 88, which extend through the hub 51. The advancing conduits 86, 88 lead into the outer groove 51*a*. A retarding conduit 85 extends from each retarding conduit port 80 through the circular plate 52. Each retarding conduit 85 is further connected to retarding conduits 87, 89, which extend through the hub 51. The retarding conduits 87, 89 lead into the outer groove 51*b*.

The hub 51 of the timing pulley 24*a* has an inner surface 51*c* along which a wide inner groove 91 extends. Each retarding conduit 87 is connected to the inner groove 91 by a lubrication conduit 90. Accordingly, the hydraulic oil flowing through the retarding conduits 87 is drawn toward the inner surface 51*c* of the hub 51 and the outer surface 22*b* of the intake camshaft 22 to function as a lubricant.

The outer groove 51*a* of the hub 51 is connected to a second oil control valve 94 by an advancing conduit 92, which extends through the cylinder head 14. The other outer groove 51*b* is connected to the second oil control valve 94 by a retarding conduit 93, which extends through the cylinder head 14.

A supply channel 95 and a discharge channel 96 are connected to the second oil control valve 94. The supply channel 95 is connected to the oil pan 13*a* by way of the oil pump P, which is also used by the first oil control valve 36. The discharge channel 95 is directly connected to the oil pan 13*a*. Accordingly, the oil pump P feeds hydraulic oil into two supply channels 37, 95.

The structure of the second oil control valve 94 is the same as that of the first oil control valve 36. The second oil control valve 94 includes a casing 102. The casing 102 has a first supply/discharge port 104, a second supply/discharge port 106, valve elements 107, a first discharge port 108, a second discharge port 110, a supply port 112, a coil spring 114, an electromagnetic solenoid 116, and a spool 118. The first supply/discharge port 104 is connected to the retarding conduit 93, which extends through the cylinder head 14. The second supply/discharge port 106 is connected to the advancing conduit 92, which extends through the cylinder head 14. The supply port 112 is connected to the supply channel 95. The first and second discharge ports 108, 110 are connected to the discharge channel 96.

When the electromagnetic solenoid 116 is de-excited, the spool 118 is moved to one side of the casing 102 (to the right side as viewed in FIG. 4) by the force of the coil spring 114. This connects the first supply/discharge port 104 to the first discharge port 108 and the second supply/discharge port 106 to the supply port 112. In this state, the hydraulic oil contained in the oil pan 13*a* is sent to the first pressure chambers 70 of the phase adjustor 24 through the supply channel 95, the second oil control valve 94, the advancing conduit 92, the outer groove 51*a*, the advancing conduits 88, 86, 84, the advancing conduit ports 80, and the sinks 62*a*, 63*a*, 64*a*, 65*a*. In addition, the hydraulic oil in the second pressure chambers 71 of the phase adjustor 24 is returned to the oil pan 13*a* through the sinks 62*b*, 63*b*, 64*b*, 65*b*, the retarding conduit ports 81, the retarding conduits 85, 87, 89, the outer groove 51*b*, the retarding conduit 93, the second oil control valve 94, and the discharge channel 96. As a result, the vane rotor 61 is rotated relatively to the housing 59 in the advancing direction to advance the valve timing of the intake valves 20.

When the electromagnetic solenoid 116 is excited, the spool 118 is moved to the other side of the casing 102 (to the left side as viewed in FIG. 4), countering the force of the coil spring 114. This connects the second supply/discharge port 106 to the second discharge port 110 and the first supply/discharge port 104 to the supply port 112. In this state, the hydraulic oil contained in the oil pan 13*a* is sent to the second pressure chambers 71 of the phase adjustor 24 through the supply channel 95, the second oil control valve 94, the retarding conduit 93, the outer groove 51*b*, the retarding conduits 89, 87, 85, the retarding conduit ports 81, and the sinks 62*b*, 63*b*, 64*b*, 65*b*. In addition, the hydraulic oil in the first pressure chambers 70 of the phase adjustor 24 is returned to the oil pan 13*a* through the sinks 62*a*, 63*a*, 64*a*, 65*a*, the advancing conduit ports 80, the advancing conduits 84, 86, 88, the outer groove 51*a*, the advancing conduit 92, the second oil control valve 94, and the discharge channel 96. As a result, the vane rotor 61 is rotated relatively to the housing 59 in the retarding direction to retard the valve timing of the intake valves 20.

By further controlling the current fed to the electromagnetic solenoid 116 to arrange the spool 118 at an intermediate position in the casing 102, the first and second supply/discharge ports 104, 106 are closed. Thus, the flow of hydraulic oil through each supply/discharge port 104, 106 is prohibited. In this state, hydraulic oil is neither supplied to nor discharged from the first and second pressure chambers 70, 71 of the phase actuator 24. This maintains the amount of the hydraulic oil residing in each pressure chamber 70, 71 and thus prohibits the vane rotor 61 from rotating relatively to the housing 59. This holds the valve timing of the intake valves 20 in a fixed state.

The first and second oil control valves 36, 94 of the variable valve timing apparatus 10 are controlled by the ECU 130, as shown in FIGS. 3 and 4, to adjust the opening and closing timing of the intake valves 20. As shown in FIG. 1, the ECU 130 functions as a logical operation circuit that includes a central processing unit (CPU) 132, a read only memory (ROM) 133, a random access memory (RAM) 134, and a backup RAM 135.

The ROM 133 stores various types of control programs, tables, and maps. The tables and maps are referred to during execution of the control programs. The CPU 132 executes the necessary computations based on the control programs stored in the ROM 133. The RAM 134 temporarily stores the results of the computations executed by the CPU 132 and data sent from various sensors. The backup RAM 135 is a non-volatile memory that keeps the necessary data stored when the engine 11 is not running. The CPU 132, the ROM 133, the RAM 134, and the backup RAM 135 are connected to one another by a bus 136. The bus 136 also connects the CPU 132, the ROM 133, the RAM 134, and the backup RAM 135 to an external input circuit 137 and an external output circuit 138.

The external input circuit 137 is connected to an engine speed sensor, an intake pressure sensor, a throttle sensor, other sensors employed to detect the operating state of the engine 11, an electromagnetic crankshaft pickup 123, and an electromagnetic camshaft pickup 126. The external output circuit 138 is connected to the first and second oil control valves 36, 94.

Accordingly, the ECU 130 controls the valve timing of the intake valves 20. The ECU 130 drives the second oil control valve 94 based on the detection data sent from the sensors to actuate the phase adjustor 24 and optimize the valve timing of the intake valves 20 in accordance with the current operating state of the engine 11. The ECU 130 also drives the first oil control valve 36 based on the detection data sent from the sensors to actuate the left adjustor 22*a* and optimize the opening duration and lift amount of the intake valves 20 in accordance with the current operating state of the engine 11.

In the phase adjustor 24 of the variable valve timing apparatus 10, the hydraulic pressure of the first and second pressure chambers 70, 71 is adjusted through an oil passage that extends through the timing pulley 24*a*, which rotates together with the housing 59. The oil passage is defined by the advancing conduits 84, 86, 88, the outer groove 85, the retarding conduits 87, 89, and the outer groove 51*b*.

The phase adjustor 24 of the variable valve timing apparatus 10 differs from the prior art in that an oil passage does not extend from the intake camshaft 22 to the vane rotor 61, which serves as a second rotating body. The first and second pressure chambers 70, 71 are provided with hydraulic pressure communicated through the oil passage (the conduits 84, 86, 88, 87, 89 and the outer grooves 51*a*, 51*b*), which extends though the timing pulley 24*a*. The timing pulley 24*a* serves as part of a first rotating body.

Therefore, hydraulic oil is not required to pass through the cylindrical space 61*c* of the vane rotor 61 due to the oil passage that communicates hydraulic pressure to the first and second pressure chambers 70, 71. Thus, the volume of the cylindrical space 61*c*, which changes in accordance with the movement of the intake camshaft 22, does not affect the hydraulic pressure of the first and second pressure chambers 70, 71. In other words, the lift adjustor 22*a* has no influence on the rotating phase of the intake camshaft 22*a* relative to the crankshaft 15. Therefore, valve timing control is performed with high precision.

In the preferred and illustrated embodiment, the vanes 66, 67, 68, 69 of the vane rotor 61 divide the first and second pressure chambers 70, 71 in the space between the associated partitions 62, 63, 64, 65.

Accordingly, each first pressure chamber 70, which advances the valve timing of the intake valves 20, is formed independently from the associated second pressure chamber 71, which delays the valve timing of the intake valves 20. Thus, the first pressure chambers 70 need not share the same oil passage as the second pressure chambers 71 and thus have oil passages that are independent from those of the second pressure chambers 71. Thus, the hydraulic pressure of the first pressure chambers 70 is unaffected by that of the second pressure chambers 71.

The oil passages are not exposed to the cylindrical space 61*c* of the vane rotor 61. Thus, the oil passages have a simple structure. This minimizes oil leakage and communicates pressure efficiently. Furthermore, the structure of the oil passages improves the response of the phase actuator 24 and enables more rigid positioning of the rotating bodies.

Additionally, seals for preventing oil leakage from the cylindrical space 61*c* are unnecessary. Machining that would be necessitated by such seals is also unnecessary. This improves efficiency during production of the engines 11. Thus, the opening 60*a* of the cover 60 is open and unsealed.

The oil conduits 84–89 employed to communicate hydraulic pressure to the first and second pressure chambers 70, 71 are all formed in the phase actuator 24. Thus, the conduits 84–89 can be formed by the same machine during the same machining process. This improves machining efficiency.

The retarding conduits 85, 87, 89 also function as a lubricant passage. In other words, the hydraulic oil flowing through the retarding conduits 85, 87, 89 is used as a lubricant. The hydraulic oil flowing through the retarding conduits 85, 87, 89 is used to lubricate the areas of contact between the intake camshaft 22, the hub 51, and the circular plate 52, and the areas of contact between the timing pulley 24*a* and the intake camshaft 22. Thus, a lubricating system for exclusively lubricating the portions of contact between the timing pulley 24*a* and the intake camshaft 22 is unnecessary. This reduces production costs.

It should be apparent to those skilled in the art that the present invention may be embodied in many other specific forms without departing from the spirit or scope of the invention. For example, the present invention may be modified as described below.

In the preferred and illustrated embodiment, the lubrication conduit 90 can be formed to extend from the advancing conduits 84, 86, 88.

In the preferred and illustrated embodiments, the lift adjustor 22*a* and the phase adjustor 24 are arranged on the ends of the intake camshaft 22. However, the lift adjustor 22*a* and the phase adjustor 24 may be arranged on the ends of the exhaust camshaft 22 instead. In this case, the exhaust cams 28 are formed as three-dimensional cams. Both the intake camshaft 22 and the exhaust camshaft 23 may be provided with the lift adjustor 22*a* and the phase adjustor 24.

In the preferred and illustrated embodiment, the drive force of the crankshaft 15 is transmitted by the timing belt 26 and the timing pulley 24*a*. However, other transmission mechanisms may be employed instead. For example, the transmission mechanism may employ chains, sprockets, or gears.

Therefore, the present examples and embodiments are to be considered as illustrative and not restrictive, and the invention is not to be limited to the details given herein, but may be modified within the scope and equivalence of the appended claims.

What is claimed is:

1. A variable valve timing apparatus for an engine, wherein the engine includes a drive shaft, a camshaft rotated by the drive shaft, a cam arranged on the camshaft, and a valve driven by the cam with a certain timing and a certain amount of lift, the variable valve timing apparatus changing the rotational phase of the camshaft relative to the drive shaft to vary the valve timing, wherein the apparatus comprises:

a first rotating body rotated synchronously with the drive shaft, wherein the first rotating body houses a fluid pressure chamber;

a second rotating body rotated synchronously with the camshaft, wherein the second rotating body includes a movable pressure receiver to which the fluid pressure of the pressure chamber is applied, wherein movement of the pressure receiver rotates the second rotating body relative to the first rotating body to change the rotational phase of the camshaft relative to the drive shaft; and a fluid passage for delivering fluid to the pressure chamber to move the pressure receiver, wherein the fluid passage extends through the first rotating body without extending through the second rotating body and the camshafts wherein the cam has a cam surface contacting the valve, the cam surface having a cross-sectional profile that changes axially, wherein the apparatus further comprises a camshaft moving mechanism for moving the camshaft axially to adjust the lift amount of the valve, the camshaft being axially movable relative to the second rotating body, wherein axial movement of the camshaft changes the axial position of the cam surface relative to the valve.

2. The apparatus according to claim 1 further comprising a spline mechanism arranged between the second rotating body and the camshaft to rotate the second rotating body synchronously with the camshaft and to permit axial movement of the camshaft relative to the second rotating body.

3. A variable valve timing apparatus for an engine, wherein the engine includes a drive shaft, a camshaft rotated by the drive shaft, a cam arranged on the camshaft, and a valve driven by the cam with a certain timing and a certain amount of lift, wherein the cam has a cam surface contacting the valve, the cam surface having a cross-sectional profile that changes axially, wherein the apparatus includes a phase adjustor for adjusting the rotational phase of the camshaft relative to the drive shaft to vary the valve timing and a lift adjustor for moving the camshaft axially to adjust the lift amount of the valve, wherein axial movement of the camshaft changes the axial position of the cam surface relative to the valve, the phase adjustor comprising:

a first rotating body rotated synchronously with the drive shaft, wherein the first rotating body houses a fluid pressure chamber;

a second rotating body rotated synchronously with the camshaft, the camshaft being axially movable relative to the second rotating body, wherein the second rotating body includes a movable pressure receiver to which the fluid pressure of the pressure chamber is applied, wherein movement of the pressure receiver rotates the second rotating body relative to the first rotating body to change the rotational phase of the camshaft relative to the drive shaft; and a fluid passage for delivering fluid to the pressure chamber to move the pressure receiver, wherein the fluid passage extends through the first rotating body without extending through the second rotating body and the camshaft.

4. A variable valve timing apparatus for an engine, wherein the engine includes a drive shaft, a camshaft rotated by the drive shaft, a cam arranged on the camshaft, and a valve driven by the cam with a certain timing and a certain amount of lift, the variable valve timing apparatus changing the rotational phase of the camshaft relative to the drive shaft to vary the valve timing, wherein the apparatus comprises:

a first rotating body rotated synchronously with the drive shaft, wherein the first rotating body houses a fluid pressure chamber;

a second rotating body rotated synchronously with the camshaft, wherein the second rotating body includes a movable pressure receiver to which the fluid pressure of the pressure chamber is applied, wherein movement of the pressure receiver rotates the second rotating body relative to the first rotating body to change the rotational phase of the camshaft relative to the drive shaft; and a fluid passage for delivering fluid to the pressure chamber to move the pressure receiver, wherein the fluid passage extends through the first rotating body without extending through the second rotating body and the camshaft;

wherein the first rotating body houses at least one cavity, the second rotating body being accommodated in the first rotating body, wherein the pressure receiver moves in the cavity and defines a first pressure chamber and a second pressure chamber in the cavity, wherein the fluid pressure chamber includes the first and second pressure chambers, and wherein the fluid passage includes a first conduit connected to the first pressure chamber and a second conduit connected to the second pressure chamber.

5. The apparatus according to claim 4, wherein the pressure receiver moves in a first direction and an opposite second direction, the pressure receiver moving in the first direction to advance the valve timing and moving in the second direction to retard the valve timing, the first pressure chamber being arranged on one side of the pressure receiver and the second pressure chamber being defined on an opposite side of the pressure receiver.

6. A variable valve timing apparatus for an engine, wherein the engine includes a drive shaft, a camshaft rotated by the drive shaft, a cam arranged on the camshaft, and a valve driven by the cam with a certain timing and a certain amount of lift, wherein the cam has a cam surface contacting the valve, the cam surface having a cross-sectional profile that changes axially, wherein the apparatus includes a phase adjustor for adjusting the rotational phase of the camshaft relative to the drive shaft to vary the valve timing and a lift adjustor for moving the camshaft axially to adjust the lift amount of the valve, wherein axial movement of the camshaft changes the axial position of the cam surface relative to the valve, the phase adjustor comprising:

a first rotating body rotated synchronously with the drive shaft, wherein the first rotating body is arranged on the camshaft and houses a cavity, the first rotating body being rotatable relative to the camshaft;

a second rotating body accommodated in the first rotating body and rotated synchronously with the camshaft, the camshaft being axially movable relative to the second rotating body, wherein the second rotating body includes a movable vane arranged in the cavity and defining a first pressure chamber and a second pressure chamber in the cavity, wherein the vane moves in a first direction and an opposite second direction, wherein the vane moves in the first direction to advance the valve timing and in the second direction to retard the valve timing, and movement of the vane rotates the second rotating body relative to the first rotating body to change the rotational phase of the camshaft relative to the drive shaft;

a first fluid passage for delivering fluid to the first pressure chamber to move the vane in the first direction, the first fluid passage extending through the first rotating body; and a second fluid passage for delivering fluid to the second pressure chamber to move the vane in the second direction, the second fluid passage extending through the first rotating body.

7. The apparatus according to claim 6, wherein the phase adjustor further comprises a spline mechanism arranged between the second rotating body and the camshaft to rotate the second rotating body synchronously with the camshaft and to permit axial movement of the camshaft relative to the second rotating body.

8. The apparatus according to claim 6, wherein at least one of the first fluid passage and the second fluid passage additionally functions to feed a lubricant between the first rotating body and the camshaft.

9. The apparatus according to claim 6, wherein the first rotating body includes a pulley arranged on the camshaft, the pulley being rotatable relative to the camshaft and being operably connected to the drive shaft, and a substantially cylindrical housing fixed to one side of the pulley, and wherein the second rotating body is concentric to and arranged in the housing, the second rotating body cooperating with the housing to define the first and second pressure chambers.

10. The apparatus according to claim 9, wherein the first and second fluid passages extend through the pulley.

11. The apparatus according to claim 10, wherein said first and second fluid passages extend through the first rotating body without extending through the second rotating body and the cam shaft.

* * * * *